US005996208A

United States Patent [19]

Nys

[11] Patent Number: 5,996,208

[45] Date of Patent: Dec. 7, 1999

[54] METHOD OF IMPROVING THE ADHESION OF A COATING SUCH AS CONCRETE TO A METAL STRIP WHICH IS HELICALLY WOUND AROUND A PIPE

[75] Inventor: Marc Nys, Moorslede, Belgium

[73] Assignee: N.V. Bekaert S.A., Zwevegem, Belgium

[21] Appl. No.: 09/062,765

[22] Filed: Apr. 20, 1998

Related U.S. Application Data

[63] Continuation-in-part of application No. 08/100,894, Aug. 2, 1993, abandoned, which is a continuation of application No. 07/864,691, Apr. 7, 1992, abandoned.

[30] Foreign Application Priority Data

Apr. 10, 1991 [BE] Belgium ..... 09100328
Feb. 19, 1992 [BE] Belgium ..... 9203628

[51] Int. Cl.[6] ..... B21D 35/00; B23P 19/04

[52] U.S. Cl. ..... 29/469.5; 29/460; 264/279.1; 264/273

[58] Field of Search ..... 140/105, 107; 245/2, 5, 7, 8, 10, 11; 138/173–175; 264/32, 35, 279.1, 273, 274, 228; 29/460, 469.5, 897.34

[56] References Cited

U.S. PATENT DOCUMENTS

| | | | |
|---|---|---|---|
| 3,919,026 | 11/1975 | Mizutani et al. . | |
| 4,033,387 | 7/1977 | Nijs et al. | 140/105 |
| 4,081,159 | 3/1978 | Baldwin | 245/2 |
| 4,134,197 | 1/1979 | Nijs et al. | 140/105 X |
| 4,235,831 | 11/1980 | Larive . | |
| 4,358,078 | 11/1982 | Tolliver . | |
| 4,369,941 | 1/1983 | Nijs . | |
| 4,439,972 | 4/1984 | Tolliver | 138/175 X |
| 4,482,420 | 11/1984 | Morimoto et al. . | |
| 4,633,568 | 1/1987 | Marchesi et al. | 138/175 X |
| 4,657,049 | 4/1987 | Fourty et al. . | |
| 4,702,282 | 10/1987 | Marchesi et al. | 138/176 |
| 4,785,854 | 11/1988 | Jarvis et al. | 138/146 X |

FOREIGN PATENT DOCUMENTS

| | | |
|---|---|---|
| 258542 | 11/1967 | Austria . |
| 700627 | 12/1964 | Canada . |
| 0045284 | 2/1982 | European Pat. Off. . |
| 0067266 | 12/1982 | European Pat. Off. . |
| 1484343 | 12/1968 | Germany . |
| 394568 | 11/1965 | Switzerland . |
| 482884 | 1/1970 | Switzerland . |
| 204497 | 10/1923 | United Kingdom . |

*Primary Examiner*—Frances Han
*Attorney, Agent, or Firm*—Shlesinger, Arkwright & Garvey LLP

[57] ABSTRACT

A method of improving the adhesion of a coating such as concrete to a metal strip which is helically wound around a pipe including a metal strip having the longitudinal and transverse wires, choosing distances between neighboring longitudinal wires that are evenly distributed over the length of the pipe including overlapping zones, overlapping the longitudinal wires having greater deformations which are offset from the longitudinal wires with smaller deformations in a direction along the central axis of the pipe and are offset in a direction away from the central axis of the pipe and all the deformations are disposed in the same plane.

16 Claims, 4 Drawing Sheets

METHOD OF IMPROVING THE ADHESION OF A COATING SUCH AS CONCRETE TO A METAL STRIP WHICH IS HELICALLY WOUND AROUND A PIPE

CROSS-REFERENCE TO RELATED APPLICATIONS

This application is a continuation-in-part of U.S. application Ser. No. 08/100,894, filed Aug. 2, 1993, now abandoned which is a continuation of U.S. application Ser. No. 07/864,691, filed Apr. 7, 1992, now abandoned which claims the priority of Belgium Application No. 9203628.4, filed Feb. 19, 1992 and which claims the priority of Belgium Application No. 09100328, filed Apr. 10, 1991, and each of which applications is hereby incorporated herein by reference.

FIELD OF THE INVENTION

The invention relates to a method of improving the adhesion of a coating such as concrete to a metal strip which is helically wound around a pipe.

BACKGROUND OF THE INVENTION

It is sometimes necessary to apply a heavy coating of concrete or the like to pipes for underwater use, for example oil pipelines, to counteract their buoyancy. Such heavy coatings require reinforcement to enable them to withstand the forces they encounter in use.

From U.S. Pat. Nos. 4,033,387 and 4,134,197, along with the corresponding patents of applicant N. V. BEKAERT S.A., it is already known how to use for this purpose the reinforcing strip of welded wire mesh mentioned in the opening lines. The applicant, N. V. BEKAERT S.A., markets these reinforcing strips under the trade name ARMAPIPE®. In a special embodiment of this known reinforcing strip, all longitudinal wires of the welded mesh are equally deformed and evenly distributed over the breadth (width) of the reinforcing strip.

In winding such a reinforcing strip around a pipe or during the embedding of such a strip in the coating while the coating is being applied to the pipe, it is in most cases desirable that the successive windings of a layer of reinforcing strip should partially overlap one another.

In the use of the reinforcing strips known up to the present, there is the disadvantage that, in winding the strip with partial overlapping of the adjacent successive windings, the adhesion of the concrete coating to the reinforcing metal strips is unsufficient.

SUMMARY OF THE INVENTION

It is an object of the invention to avoid this disadvantage of insufficient adhesion.

According to the invention, there is provided a method of improving the adhesion of a coating such as concrete to a metal strip which is helically wound around a pipe, the method comprising the steps of:

(a) providing a pipe;

(b) providing a metal strip, said metal strip comprising longitudinal wires and transverse wires, the longitudinal wires having plastical deformations, the transverse wires being welded to the longitudinal wires;

(c) winding said metal strip helically around said pipe such that adjacent windings overlap partially with each other in overlapping zones and such that the distance between a central axis of the pipe and the longitudinal wires at one side of the strip is greater than the distance between a central axis of the pipe and the longitudinal wires at the other side of the strip;

(d) providing the coating around the pipe;

(e) choosing the distances between two neighbouring longitudinal wires so that the longitudinal wires are evenly distributed over the length of the pipe including the overlapping zones;

(f) choosing the deformations in the longitudinal wires so that in the overlapping zones longitudinal wires with greater deformations are alternated with and separated from longitudinal wires with smaller deformations.

Indeed it has been experienced by the inventor that loss of adhesion of the concrete coating around the pipe is often located at spots when there is a concentration of metal wires in the coating. The method according to the invention combines two measures:

1. an equal distribution of the longitudinal wires across the length of the pipe with inclusion of the overlapping zones;
2. choice of the amplitude of the deformations in the longitudinal wires so that they remain separated from each other and do not cross each other.

To this end, with the metal reinforcing strip of the type mentioned in the opening lines, the invention proposes that the longitudinal wires in the middle zone of the reinforcing strip be attached at a unit distance from one another or evenly distributed over the breadth (width) of the strip, while the longitudinal wires in the edge zones of the reinforcing strip be attached over the breadth (width) of the strip in such a way that when the upper edge zone is wound round a cylindrical object thereby overlapping the lower edge zone, the longitudinal wires are evenly distributed over the overlapping zones when the distance between each pair of adjacent longitudinal wires of the two zones during the overlapping winding is roughly equal to the unit distance.

In a preferred embodiment of the reinforcing strip according to the invention, the distance between each pair of adjacent longitudinal wires in the edge zones is equal to twice the unit distance between each pair of longitudinal wires in the middle zone.

In yet another embodiment, each edge zone consists of only two longitudinal wires.

Preferably, all longitudinal wires of the reinforcing strip according to the invention are uniformly deformed.

In order to reduce still more the risk of bad adhesion between the reinforcing strip the diameter of the longitudinal wires is choosen greater than the diameter of the transverse wires.

Another measure is to limit as much as possible—whilst still maintaining the minimum reinforcing action—the total quantity of steel in the cross-section of the coating around the pipe. To this end, the longitudinal cross-sectional area of the metal strip preferably ranges from 0.1% to 0.7% of the cross-sectional area of the coating around the pipe, the longitudinal cross-sectional area of the metal strip being equal to the sum of the individual cross-sectional are of the transverse wires of the metal strip. To the same end, the transverse cross-sectional area of the metal strip preferably ranges from 0.025% to 0.20% of the cross-sectional area of the coating around the pipe, the transverse cross-sectional area of the metal strip being equal to the sum of the individual cross-sectional are of the transverse wires of the metal strip.

BRIEF DESCRIPTION OF THE DRAWINGS

The invention will now be explained in more detail in the following description on the basis of the accompanying drawing. In the drawing.

DESCRIPTION OF PREFERRED EMBODIMENTS

Figure 1:
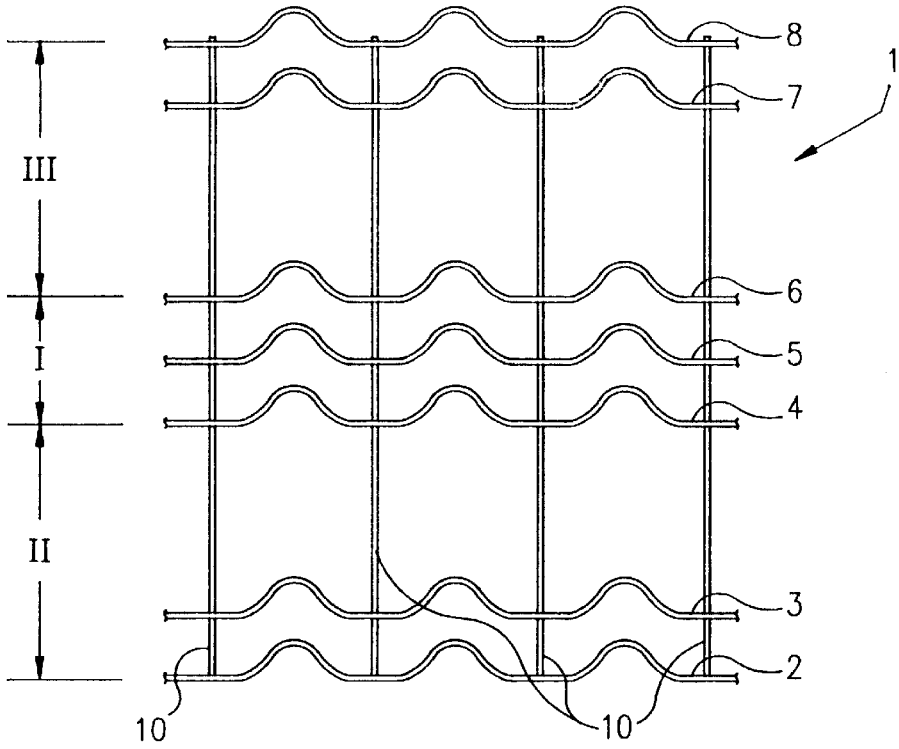
FIG. 1 shows a part of a first embodiment of a reinforcing strip according to the invention.

FIG. 1 shows a part of a first embodiment of a reinforcing strip 1 according to the invention. The reinforcing strip 1 consists of seven longitudinal wires 2–8 with transverse wires 10 welded to them at nearly right angles and at a regular distance from one another. By preference, the longitudinal wires 2–8 are uniformly deformed. The longitudinal wires 2–8 can also be straight wires. Three zones are distinguished across the breadth of the reinforcing strip 1: zones I, II and III, or a middle zone I, a lower edge zone II and an upper edge zone III. The middle zone I contains three longitudinal wires 4, 5 and 6, for which the distance between each pair of longitudinal wires is equal, for example, one inch or 25.4 mm. It is clear that the middle zone I can contain more or less than three longitudinal wires. The characteristic feature of the middle zone I is that the distance between each pair of adjacent longitudinal wires is equal or that the longitudinal wires in the middle zone I are attached at a unit distance from one another. The longitudinal wires 4, 5 and 6 are thus evenly distributed over the breadth (width) of the strip in the middle zone I.

The lower edge zone II and the upper edge zone III each contain three longitudinal wires: 2, 3, 4 and 6, 7, 8, respectively. The distance between each pair of adjacent longitudinal wires in these edge zones II and III is not equal. Thus the distance between the longitudinal wires 2, 3 (7, 8) is nearly one inch or 25.4 mm, while the distance between the longitudinal wires 3, 4(6, 7) amounts to nearly three inches or 76.2 mm.

The characteristic feature of these edge zones II and III is that in the overlapping winding of these zones II and III when strip 1 is being wound around a cylindrical object, such as a pipe, it is now possible to ensure that the longitudinal wires of both zones II and III are evenly distributed over the overlapping zones II and III and that the distance between each pair of adjacent longitudinal wires in both these zones is equal to the distance between each pair of adjacent longitudinal wires in the middle zone I, or the unit distance. For this purpose it is necessary to make sure that the two longitudinal wires 7, 8 of the upper zone III lie between the longitudinal wires 3, 4 of the lower zone II and that the distance between the adjacent wires 3 and 7 or 4 and 8 of the two zones is nearly equal to the unit distance or the distance between each pair of adjacent longitudinal wires in the middle zone I.

Figure 2:
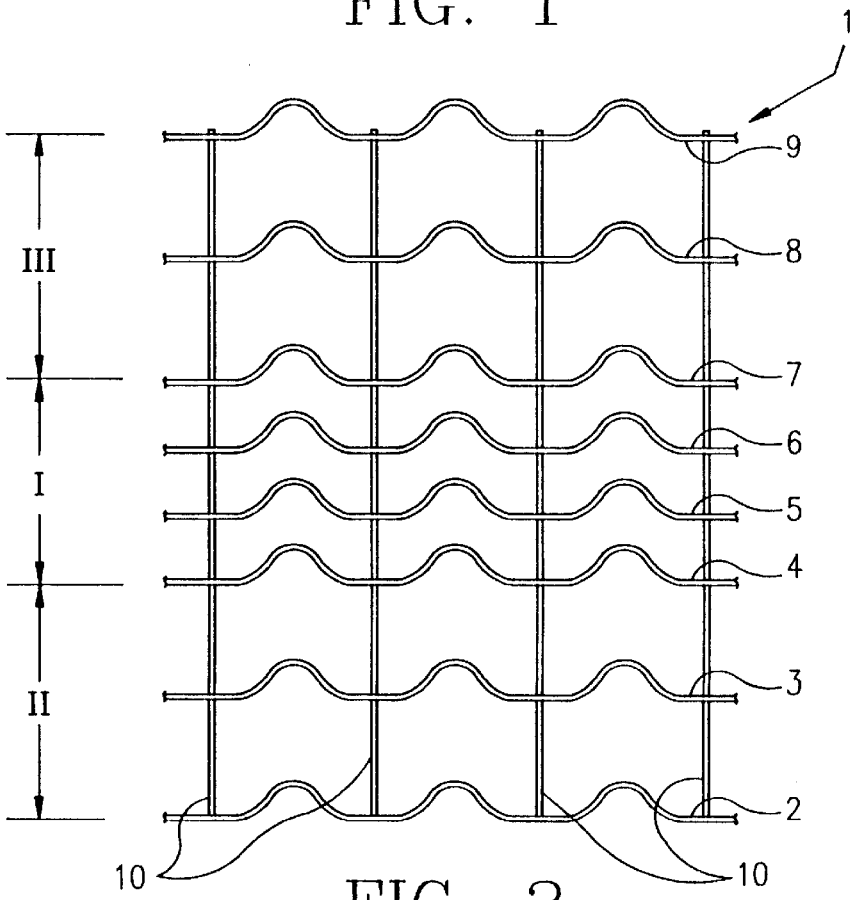
FIG. 2 shows a part of a second embodiment of a reinforcing strip according to the invention.

FIG. 2 shows a part of a second embodiment of a reinforcing strip 1 according to the invention. The three zones I, II and III are once more shown: the middle zone I includes four longitudinal wires 4, 5, 6 and 7, while the edge zones II and III include three longitudinal wires 2, 3, 4 and 7, 8, 9 respectively. The distance between each pair of adjacent longitudinal wires in the edge zones II and III is equal to twice the unit distance or twice the distance between each pair of adjacent longitudinal wires in the middle zone I. When winding so that the edge zones II and III overlap, one must now make sure that the longitudinal wires 8 and 9 of the upper zone III lie between the longitudinal wires 2, 3 and 3, 4, respectively, of the lower zone II and that the distance between each pair of adjacent longitudinal wires of the the overlapping zones II, III—for example the distance between the longitudinal wires 2 and 8—is nearly equal to the unit distance or the distance between each pair of adjacent longitudinal wires in the middle zone I.

Figure 3:
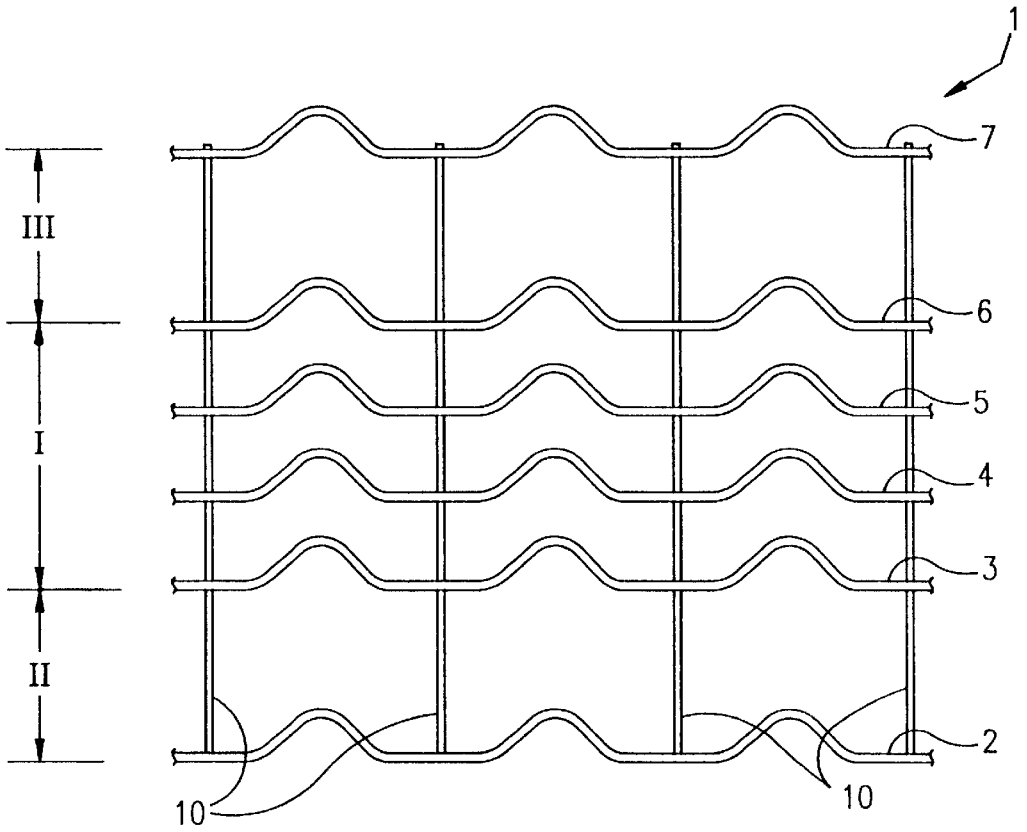
FIG. 3 shows a part of a third embodiment of a reinforcing strip according to the invention.

FIG. 3 shows a part of a preferred embodiment of a reinforcing strip 1 according to the invention. The three zones I, II and III are once more shown; the middle zone I contains four longitudinal wires 3, 4, 5 and 6, while the edge zones II and III contain two longitudinal wires, 2, 3 and 6, 7 respectively. The distance between the adjacent longitudinal wires in edge zones II and III is equal to twice the unit distance or two times the distance between each pair of adjacent longitudinal wires in the middle zone I. By way of example, the dimensions of such a reinforcing strip 1 are given here: the unit distance is 25.4 mm; the diameter of the longitudinal wires is 2.86 mm; the diameter of the transverse wires is 2.00 mm; the distance between the transverse wires is 67 mm and the length of the reinforcing strip or roll 1 is approximately 115 m.

Figure 4:
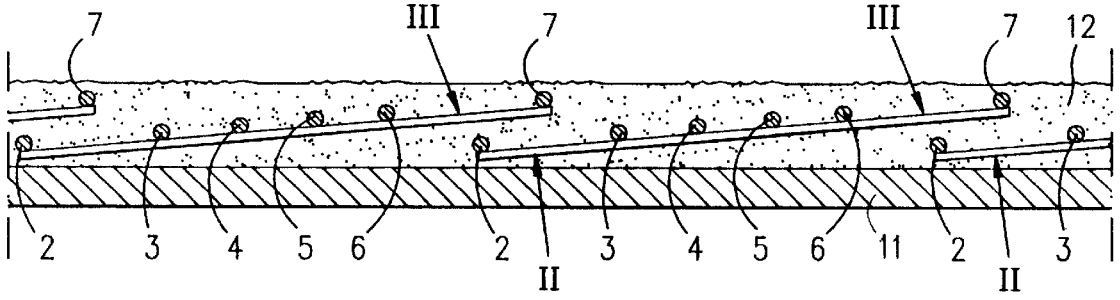
FIG. 4 shows a longitudinal cross-section through half of a part of a pipe with a coating applied to it and a reinforcing strip embedded in this coating according to FIG. 3.

FIG. 4 shows a longitudinal cross-section through half of a part of a pipe 11 with a coating 12 applied to it in which a reinforcing strip 1 according to FIG. 3 has been placed. As FIG. 4 clearly shows, with a minimum overlapping of one unit distance of the lower edge zone II by the upper edge zone III of the successive windings of the reinforcing strip 1, an even distribution of the reinforcing material over the length of the pipe 11 is obtained.

In the embodiment of the pipe 11 represented in FIG. 4 only one reinforcing strip or reinforcing layer 1 has been placed in the coating 12. It is clear that more such reinforcing layers or reinforcing strips could be placed in the coating 12.

From the embodiments described above, it is clear that when the distance between two adjacent longitudinal wires in certain parts of the edge zones II and III is not equal to the unit distance or the distance between each pair of adjacent longitudinal wires in the middle zone I, then this distance is nevertheless equal to an n-multiple of the unit distance, and that with overlapping winding one must always make sure that n-1 longitudinal wires of the one zone lie between the two longitudinal wires of the other zone that are at an n-multiple distance from one another, such that the distance between each pair of adjacent longitudinal wires of the two zones II and III is then nearly equal to the unit distance.

Figure 5:
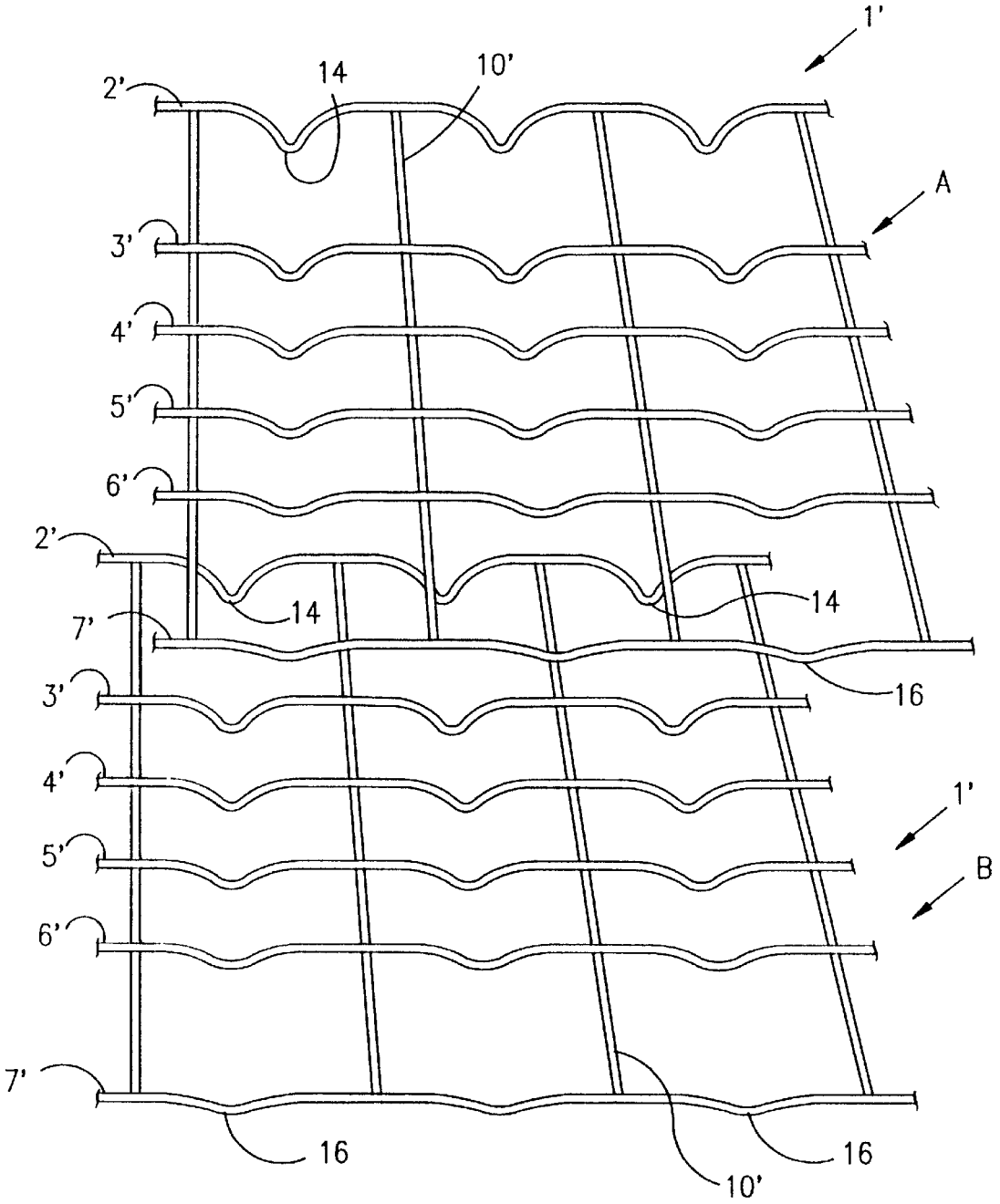
FIG. 5 shows how one winding of a strip overlaps with an adjacent winding of the strip.
Figure 6:
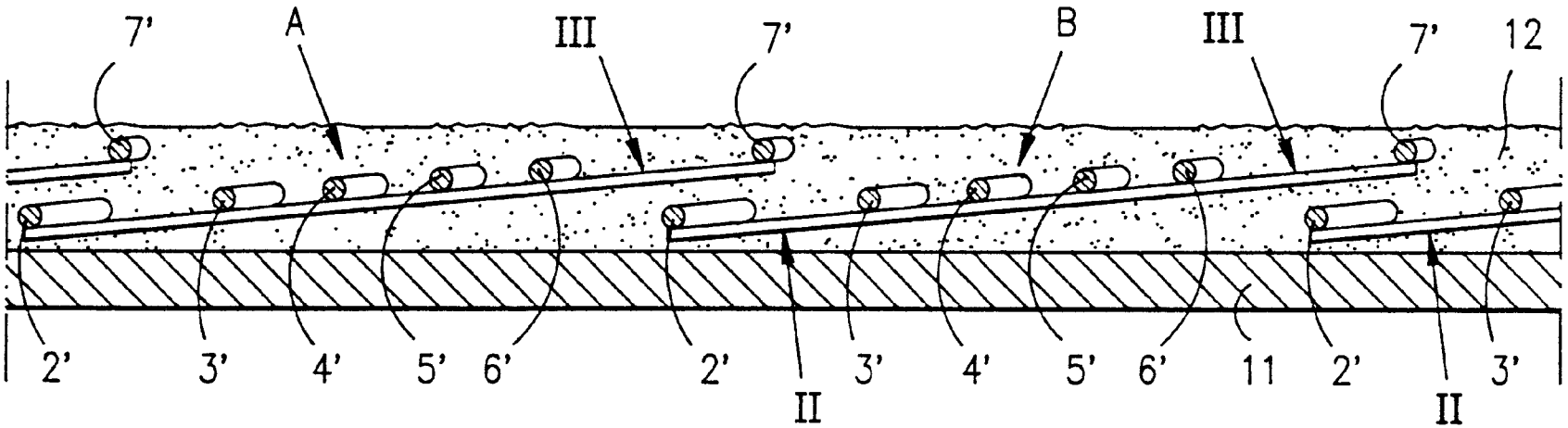
FIG. 6 shows a longitudinal cross-section through half of a part of a pipe with a coating applied to it and a reinforcing strip embedded in this coating according to FIG. 5.

FIG. 5 illustrates how two adjacent windings of a strip 1' according to the invention overlap with each other after being wound around the pipe. A first winding A overlaps a second winding B.

The longitudinal wires of the first and second windings A,B are referred to by reference numerals 2', 3', 4', 5', 6' and 7'. The amplitude of deformation 14' is highest in the longitudinal wire 2' since wire 2' lies closest to the axis of the pipe. The amplitude of deformation 16' is smallest in the longitudinal wire 7' since wire 7' lies at the greatest distance from the axis of the pipe. Wire 7' is stretched to a greater extent than wire 2' and this is the cause of the smaller deformations in wire 7'. As may be derived from FIG. 4 and from FIG. 5 the longitudinal wires are equally spaced along the axis of the pipe. Such equal spacing or even distribution of longitudinal wires along the length of the pipe in overlapping zones may be achieved by having the longitudinal wires offset from other longitudinal wires in adjacent windings in a direction along the central axis of the pipe and offset in a direction away from the central axis of the pipe. In the zone of overlapping, the longitudinal wire 2' (of second winding B) with the higher deformations does not cross the longitudinal wires 6' and 7' (of first winding A). So there is no unacceptable increase of concentration of steel in the overlapping zones. As discussed above, such unacceptable concentration of steel (i.e., wires) leads to poor adhesion of the coating.

As with the other embodiments, good results have been achieved when the deformations 2', 3', 4', 5', 6' and 7' (i.e., the greater deformations and the smaller deformations) are disposed substantially within the same plane. As with the other embodiments, deformations 2', 3', 4', 5', 6' and 7' may be permanently deformed prior to winding of the first and second windings A,B around a pipe.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A method of improving the adhesion of a coating such as concrete to a metal strip which is helically wound around a pipe, said method comprising the steps of:

(a) providing a pipe;

(b) providing a metal strip, said metal strip comprising longitudinal wires and transverse wires, the longitudinal wires having greater deformations and smaller deformations, the transverse wires being attached to the longitudinal wires;

(c) winding said metal strip helically around said pipe such that adjacent windings overlap partially with each other in overlapping zones and such that the distance between a central axis of the pipe and the longitudinal wires at one side of the strip is greater than the distance between the central axis of the pipe and the longitudinal wires at the other side of the strip;

(d) providing the coating around the pipe;

(e) choosing the distances between two neighboring longitudinal wires so that the longitudinal wires are evenly distributed over the length of the pipe including the overlapping zones; and (f) choosing the deformations in the longitudinal wires so that in the overlapping zones longitudinal wires with greater deformations are offset from longitudinal wires with smaller deformations in a direction along the central axis of the pipe and are offset in a direction away from the central axis of the pipe.

2. A method according to claim 1 wherein the diameter of the longitudinal wires is choosen greater than the diameter of the transverse wires.

3. A method according to claim 1, wherein:

a) the longitudinal cross-sectional area of the metal strip ranges from 0.1% to 0.7% of the cross-sectional area of the coating around the pipe, and the longitudinal cross-sectional area of the metal strip being equal to the sum of the individual cross-sectional areas of the longitudinal wires of the metal strip.

4. A method according to claim 3, wherein:

a) the transverse cross-sectional area of the metal strip ranges from 0.025% to 0.20% of the cross-sectional area of the coating around the pipe and the transverse cross-sectional area of the metal strip being equal to the sum of the individual cross-sectional areas of the transverse wires of the metal strip.

5. A method according to claim 1, wherein:

a) said greater deformations and said smaller deformations are disposed within the same plane.

6. A method according to claim 1, wherein:

a) each one of said longitudinal wires, said greater deformations, and said smaller deformations are disposed within the same plane.

7. A method according to claim 1, wherein:

a) in said step of providing a metal strip, the transverse wires are welded to the longitudinal wires.

8. A method of improving the adhesion of a coating such as concrete to a metal strip which is helically wound around a pipe, said method comprising the steps of:

a) providing a pipe;

b) providing a metal strip, said metal strip including longitudinal wires and transverse wires, the longitudinal wires having deformations, the transverse wires being attached to the longitudinal wires, and all the deformations being disposed within the same plane;

c) winding said metal strip helically around said pipe such that adjacent windings overlap partially with each other in overlapping zones and such that the distance between a central axis of the pipe and the longitudinal wires at one side of the strip is greater than the distance between a central axis of the pipe and the longitudinal wires at the other side of the strip;

d) providing a coating around the pipe; and e) choosing the distances between two neighboring longitudinal wires so that in the overlapping zones the longitudinal wires are offset from other longitudinal wires in adjacent windings in a direction along the central axis of the pipe and are offset in a direction away from the central axis of the pipe.

9. A method according to claim 8, wherein:

a) the diameter of the longitudinal wires is chosen greater than the diameter of the transverse wires.

10. A method according to claim 8, wherein:

a) the longitudinal cross-sectional area of the metal strip ranges from 0.1% to 0.7% of the cross-sectional area of the coating around the pipe and the longitudinal cross-sectional area of the metal strip being equal to the sum of the individual cross-sectional areas of the longitudinal wires of the metal strip.

11. A method according to claim 10, wherein:

a) the transverse cross-sectional area of the metal strip ranges from 0.025% to 0.20% of the cross-sectional area of the coating around the pipe and the transverse cross-sectional area of the metal strip being equal to the sum of the individual cross-sectional areas of the transverse wires of the metal strip.

12. A method according to claim 8, wherein:

a) said deformations on at least one of said longitudinal wires differing from the deformations on the other ones of said longitudinal wires.

13. A method according to claim 8, wherein:

a) in said step of providing a metal strip, the transverse wires are welded to the longitudinal wires.

14. A metal strip comprising:

a) longitudinal wires and transverse wires, the longitudinal wires having greater deformations and smaller deformations, the transverse wires being attached to the longitudinal wires, and all the greater and smaller deformations being disposed substantially within the same plane;

b) said metal strip being configured for being wound helically around a pipe such that adjacent windings overlap partially with each other in overlapping zones, and such that the distance between a central axis of the pipe and the longitudinal wires at one side of the strip is greater than the distance between the central axis of the pipe and the longitudinal wires at the other side of the strip when wound around the pipe, and such that longitudinal wires of adjacent windings are evenly distributed over the length of the pipe including the overlapping zones; and, c) said greater and smaller deformations being disposed in said metal strip so that, in use, when said-metal strip is wound helically around a pipe, the longitudinal wires with greater deformations are offset from the longitudinal wires with smaller deformations in a direction alone the central axis of the pipe and are offset in a direction away from the central axis of the pipe.

15. A metal strip according to claim 14, wherein:

a) said transverse wires are welded to said longitudinal wires.

16. A metal strip according to claim 14, wherein:

a) said greater deformations and said smaller deformations are disposed within the same plane.

* * * * *